US011380196B1

(12) United States Patent
Dorsey

(10) Patent No.: US 11,380,196 B1
(45) Date of Patent: Jul. 5, 2022

(54) TRAFFIC WARNING SYSTEM

(71) Applicant: Clay Robinson Dorsey, Hoover, AL (US)

(72) Inventor: Clay Robinson Dorsey, Hoover, AL (US)

( * ) Notice: Subject to any disclaimer, the term of this patent is extended or adjusted under 35 U.S.C. 154(b) by 0 days.

(21) Appl. No.: 16/949,100

(22) Filed: Oct. 13, 2020

Related U.S. Application Data

(60) Provisional application No. 62/914,547, filed on Oct. 13, 2019.

(51) Int. Cl.
*G08G 1/09* (2006.01)
*G08G 1/095* (2006.01)

(52) U.S. Cl.
CPC ..... *G08G 1/094* (2013.01); *G08G 1/095* (2013.01)

(58) Field of Classification Search
CPC ..... G08G 1/094; G08G 1/095
USPC ..... 340/907
See application file for complete search history.

(56) References Cited

U.S. PATENT DOCUMENTS 4,704,610 A * 11/1987 Smith ..... G08G 1/087 340/906
4,775,865 A * 10/1988 Smith ..... G08G 1/087 340/906
4,952,931 A * 8/1990 Serageldin ..... G08G 1/0965 340/901
5,917,431 A * 6/1999 Sanada ..... G08G 1/095 340/907
6,404,351 B1 * 6/2002 Beinke ..... G08G 1/087 340/902
6,987,464 B2 * 1/2006 Pearson ..... G08G 1/07 200/19.17
7,884,738 B2 * 2/2011 Pappas ..... G08G 1/087 340/906
9,064,411 B1 * 6/2015 Patton, Jr. ..... G09F 9/33
9,564,049 B2 * 2/2017 Diba ..... G08G 1/015
9,620,011 B2 * 4/2017 Cunningham ..... G08G 1/095
9,666,068 B2 * 5/2017 Fleming ..... E01F 9/559
9,875,653 B2 * 1/2018 Diba ..... G08G 1/087
10,672,268 B1 * 6/2020 Weader ..... G08G 1/07
11,055,991 B1 * 7/2021 Mulligan ..... G08G 1/012
2004/0008126 A1 * 1/2004 Diba ..... G08G 1/095 340/907
2004/0008127 A1 * 1/2004 Manavi ..... G08G 1/087 340/907
2007/0001872 A1 * 1/2007 Ellison ..... G08G 1/0965 340/907
2008/0258933 A1 * 10/2008 Diba ..... G09F 9/33 340/907
2009/0051567 A1 * 2/2009 Wabeke ..... G08G 1/095 340/907
2010/0182164 A1 * 7/2010 Diba ..... G09F 9/33 340/907

(Continued)

*Primary Examiner* — Eric Blount
(74) *Attorney, Agent, or Firm* — Jones Walker LLP

(57) ABSTRACT

A traffic warning system for first responders, such as the police, firefighters, and paramedics, that allows a first responder to wirelessly communicate their pending approach to an intersection with a multimedia warning system mounted and hardwired to a conventional traffic light and operated via an integrated remote control device or mobile phone application ("mobile app") using radio frequencies, BLUETOOTH® technology, wireless digital technology, or the like.

19 Claims, 12 Drawing Sheets

(56) References Cited

U.S. PATENT DOCUMENTS

| | | | | |
|---|---|---|---|---|
| 2011/0115645 | A1* | 5/2011 | Hall | G08G 1/087<br>340/907 |
| 2011/0187559 | A1* | 8/2011 | Applebaum | B60Q 1/00<br>340/907 |
| 2012/0194353 | A1* | 8/2012 | Groves | G08G 1/095<br>340/907 |

* cited by examiner

TRAFFIC WARNING SYSTEM

REFERENCE TO RELATED APPLICATIONS

This application claims priority to Provisional Utility Patent Application No. 62/914,547 filed on Oct. 13, 2019. Provisional Utility Patent Application No. 62/914,547 is incorporated by reference herein. Applicant claims the earlier filing date.

TECHNICAL FIELD OF THE INVENTION

The technology described herein relates to the field of emergency warning systems for pedestrians and motorists. More specifically, the invention is a traffic warning system for first responders, such as the police, firefighters, and paramedics, that allows a first responder to wirelessly communicate their pending approach to an intersection with a multimedia warning system mounted and hardwired to a conventional traffic light and operated via an integrated remote control device or mobile phone application ("mobile app") using radio frequencies, BLUETOOTH® technology, wireless digital technology, or the like.

BACKGROUND OF THE INVENTION

Emergency services and first responders around the world, most notably Firefighters, Police, and Ambulances, utilize flashing lights and sirens to attract the attention of vehicles in their path to move out of their way, thus allowing them to pass and expeditiously proceed to the location of an emergency.

When an emergency vehicle comes to an intersection, it is important that all vehicles approaching the intersection in different directions are made aware of the approaching emergency vehicle. Again, some drivers may not be aware of the sirens and emergency lights of the emergency vehicle, and this may result in an accident occurring with the emergency vehicle and/or other motorists or pedestrians at or near the intersection.

The main problem for the emergency services is that drivers focus is on the road ahead, only using their mirrors occasionally when they are changing lanes turning or checking their surroundings. Many modern cars have tinted windows, excellent soundproofing and quality sound systems making it more difficult for an emergency vehicle to attract a driver's attention on their approach. As a result, emergency vehicles can often be situated behind a vehicle for critical seconds before the driver realizes their presence and finally moves out of their way allowing the emergency vehicle to pass. Deaf or hearing-impaired pedestrians or pedestrians listening to music with earphones/earbuds on at high volumes also present potential hazards that traditional sirens and lights may not address.

With most emergency services, every second counts. For the ambulance service alone, arriving 20-30 seconds earlier can make the difference between life and death to people at the scene of an emergency. The public's constant unawareness of emergency vehicles creates increased stress levels for first responders as they must account for emergency vehicle blindness by pedestrians and motorists alike. Light travels in a straight line and therefore lights are only effective if there is a direct line of sight between the emergency vehicle and motorist/pedestrian, hence bends, contours and tunnels prevent the emergency vehicle from being seen.

When sirens are heard, it can be hard to pinpoint the direction of the source, thus creating confusion to the motorist/pedestrian as to the direction of approach. The siren may not be heard due to the surrounding acoustic conditions created by buildings or may be severely attenuated by high winds or ambient noise conditions for example.

In many countries when learning to drive, driver training does not include what action to take if an emergency vehicle is approaching from behind and many people stay as they were, expecting the emergency vehicle to drive around them. Often when there has been an accident/incident, approaching traffic comes to a standstill creating severe congestion. If no hard shoulder is available, it is the task of one or more of the emergency services, Fire/Police/Ambulance or Recovery vehicles, to get to the accident/incident as quickly as possible. Often the emergency services will approach the accident/incident from the direction of travel and therefore will make their way through the traffic starting at the back of the congestion.

Sometimes, because the drivers are focusing at what is ahead of them, the drivers are completely unaware that the emergency vehicle is there until it is directly behind them. They then have to suddenly find sufficient space in front of them to move diagonally enabling them to make sufficient room for the emergency vehicle to pass. If motorists are bumper-to-bumper with the car in front of them, there is no room to move diagonally unless the car in front moves first. For larger vehicles, such as tractor-trailers and the like, the space required to move over is greatly increased. This problem is very time-consuming for the emergency services as they are frantically trying to get through hundreds of vehicles. The faster the emergency services can get to an accident/incident, there is a higher chance saving lives or reduction of injuries. The faster an accident/incident can be resolved the faster the road can resume normal traffic.

Numerous patents have been issued on systems which address some of the foregoing problems. Several examples are U.S. Pat. Nos. 5,307,060, 4,403,208, 4,794,394, 4,238,778, 3,997,868, 6,011,492, 3,784,970, 5,808,560, 6,087,961, 6,222,461, and 6,292,747. Although these patents disclose various proposals for warning about the approach of an emergency vehicle, and even some provide control over the range of transmission involved, there is still a basic problem which exists with such systems because of the fact that they broadcast warnings not only to those in the relevant vicinity, but also to many vehicles which are either not in the relevant vicinity or not likely to be affected by the situation, thus further contributing to the tendency to ignore such warnings. Others are limited to vehicle-to-vehicle communications.

Hence, a traffic warning system is taught that allows a first responder to remotely signal their fast approach to an upcoming intersection from their vehicles using a remote control device or mobile app that signals the type and direction of an approaching emergency vehicle is needed.

DETAILED DESCRIPTION OF CERTAIN EMBODIMENTS

In preferred embodiments, the invention is a traffic warning system for first responders, such as the police, firefighters, and paramedics, that allows a first responder to wirelessly communicate with a multimedia warning system mounted at an approaching intersection and wirelessly coupled to traffic control devices whereby the operation of an integrated remote control device or mobile phone application ("app") downloaded on the multimedia warning system and activated using radio frequencies, BLUETOOTH® technology, or wireless digital technology. As mentioned earlier, the following teachings of the preferred embodiment of the present invention are applicable to a plurality of multimedia devices with a vast array of dimensions and technologies. No limitations are taught herein. The general principles incorporated in the invention may be applied to embodiments and applications in addition to those taught herein without departing from the context and scope of the present teachings, thus encompassing the broadest scope possible in accordance with said teachings.

The term "police" includes, but is not limited to, police officers, sheriffs, marshals, and federal law enforcement agencies (for example, the Federal Bureau of Investigation). The term "firefighters" includes, but is not limited to, firefighting responders, firemen, fire investigators, and hazardous materials incident responders. The term "ambulances" includes, but is not limited to, ambulance drivers, paramedics/medical responders, and any sanctioned entities responding to emergency situations.

Figure 7:
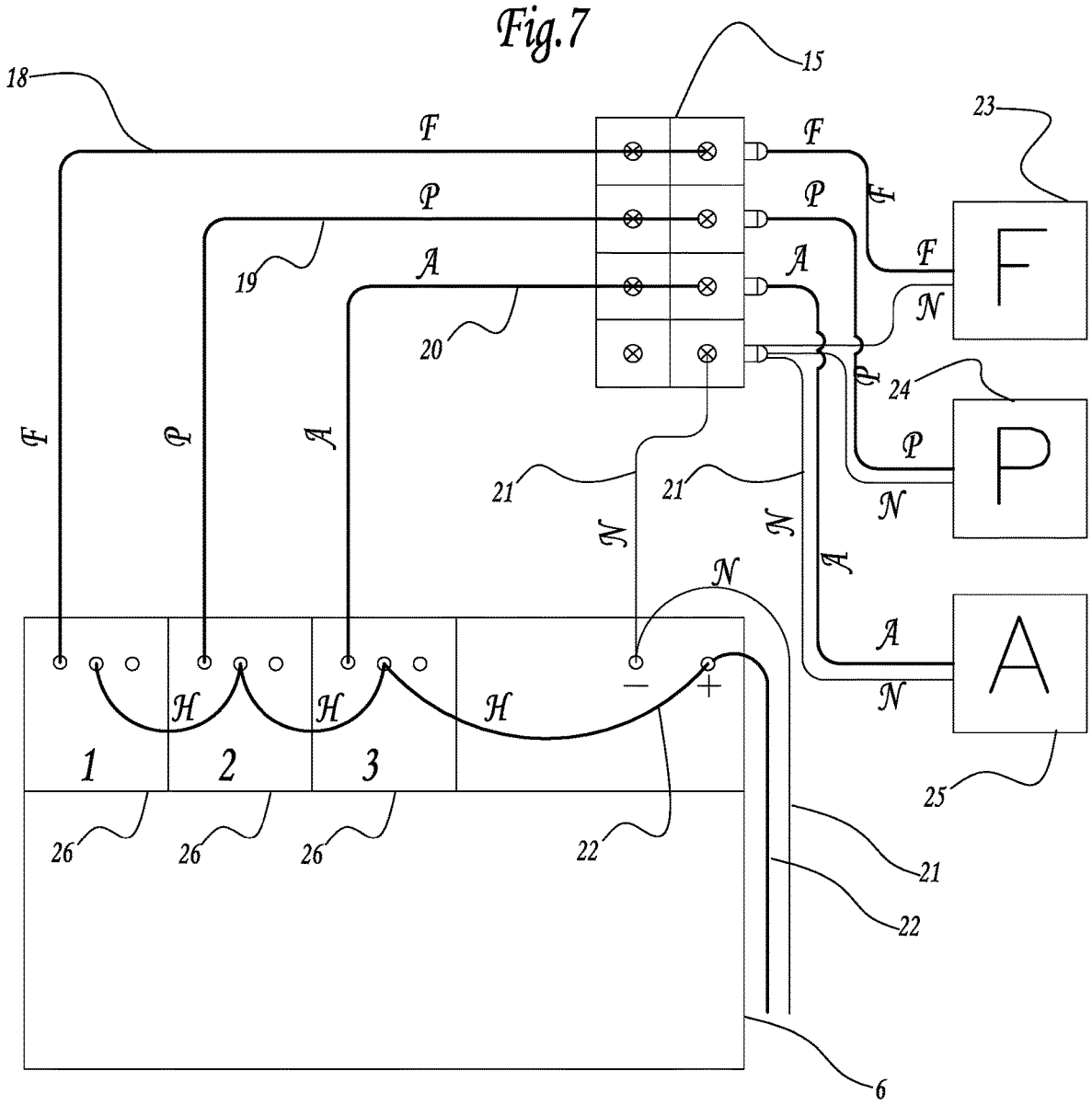
FIG. 7 is a diagram of the operational schematics of the traffic warning system of the present invention.
Figure 8:
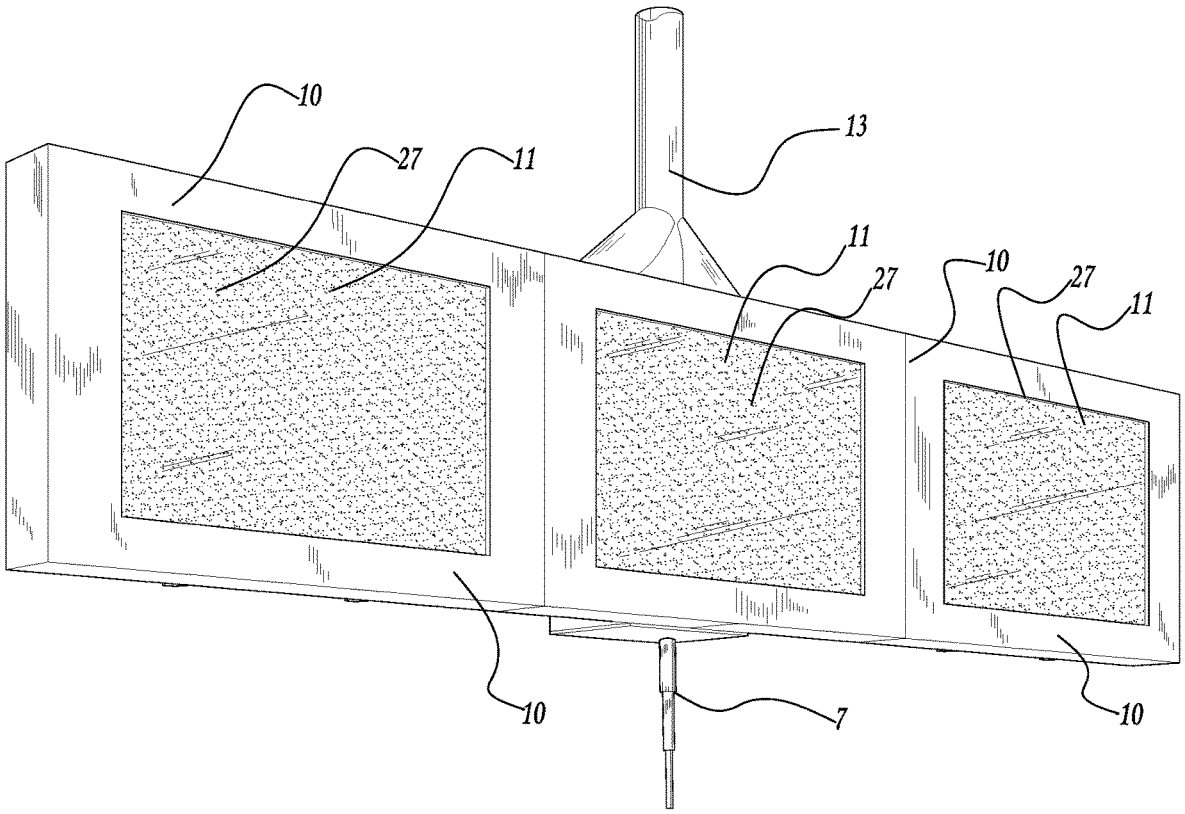
FIG. 8 is a front perspective view of an alternative embodiment of traffic warning system of the present invention.

As seen in FIG. 7, the following teachings provide a general description of a typical wireless computer/communication arrangement for effectuating the system and method taught herein. The system and method will incorporate general computer programming executable by multimedia devices such as a remote control device, smartphone, tablet, and the like. Program functionality is selectively embedded in transitory and/or a non-transitory computer readable medium containing executable commands. The invention may also be compatible with remote computing arrangements where functions are executed remotely by computing devices that are wirelessly coupled through an established communication network.

As seen in FIG. 7, the computer network may be a local area network, a wide area network, or a combination of networks that allow the computing system of the remote control devices or smartphone to communicate with the traffic warning system and remote computers, such as the remote server computer of the application architecture, either directly or indirectly. The server computer and the remote server computer are typically similar to networking arrangement discussed above.

Such a computer network facilitates transmission and receipt of commands associated with operation of the traffic warning system. These commands may be selectively executed via the wireless interface of the remote control device or smartphone with the traffic warning system. Hence, stored settings and commands may be updated, aggregated, and/or modified according to the preferences of the user and transmitted and received to and from various devices that can be coupled to a traffic warning system as taught in FIG. 7.

Figure 1:
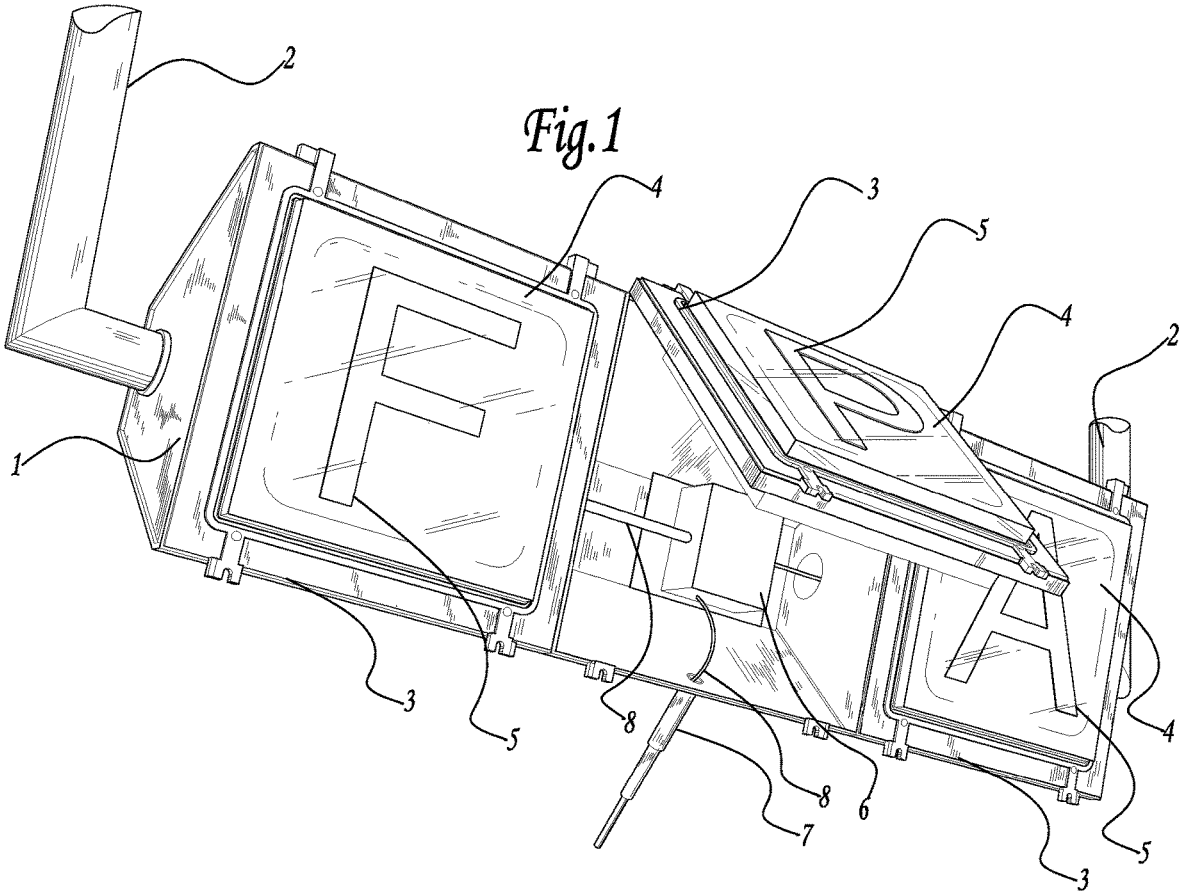
FIG. 1 is a front perspective view of the traffic warning system of the present invention.
Figure 2:
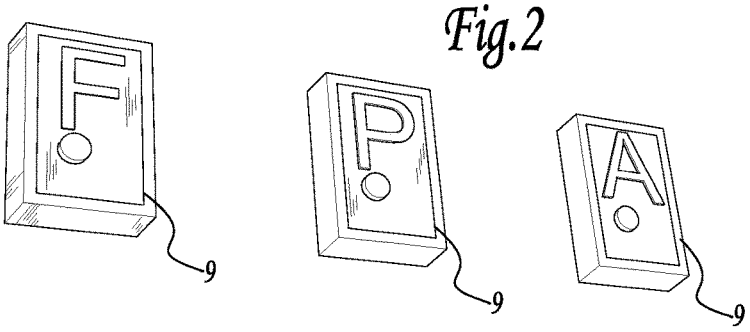
FIG. 2 is a perspective view of the remote control devices of the traffic warning system of the present invention.
Figure 3:
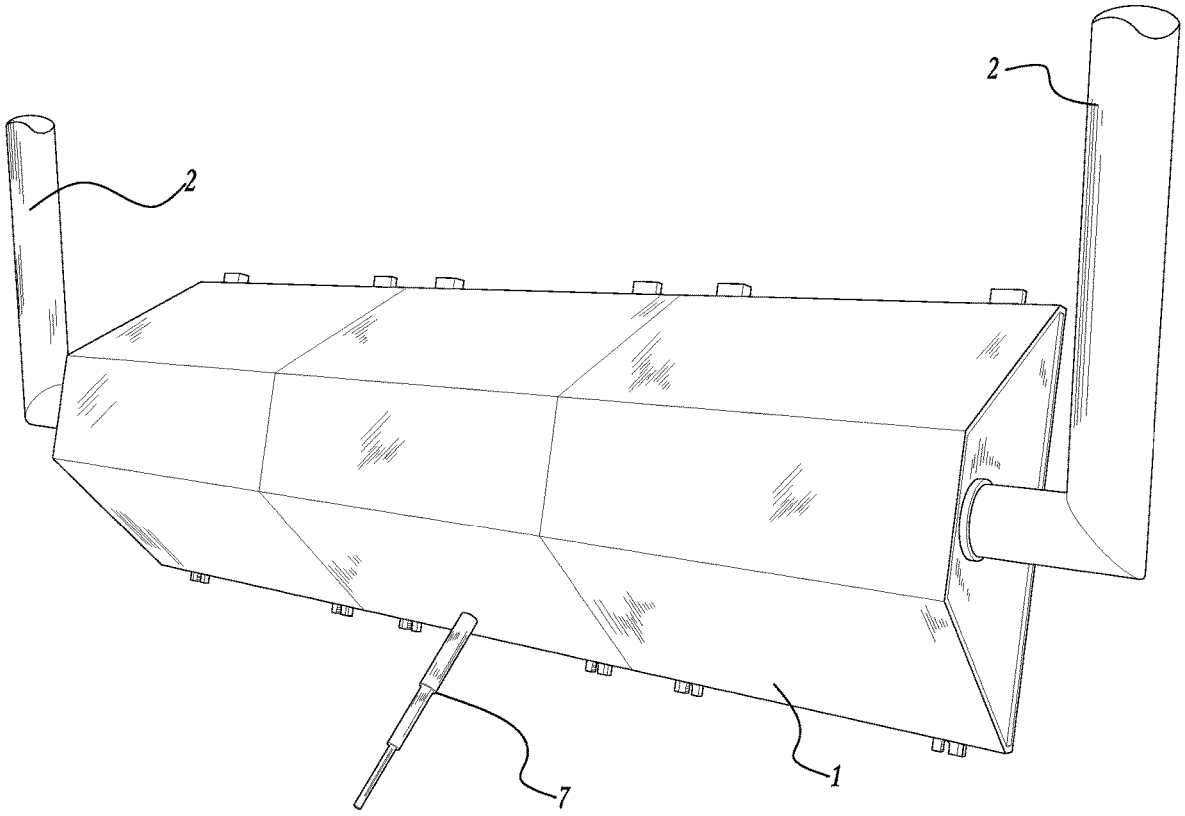
FIG. 3 is a rear perspective view of the traffic warning system of the present invention.
Figures 4, 5:
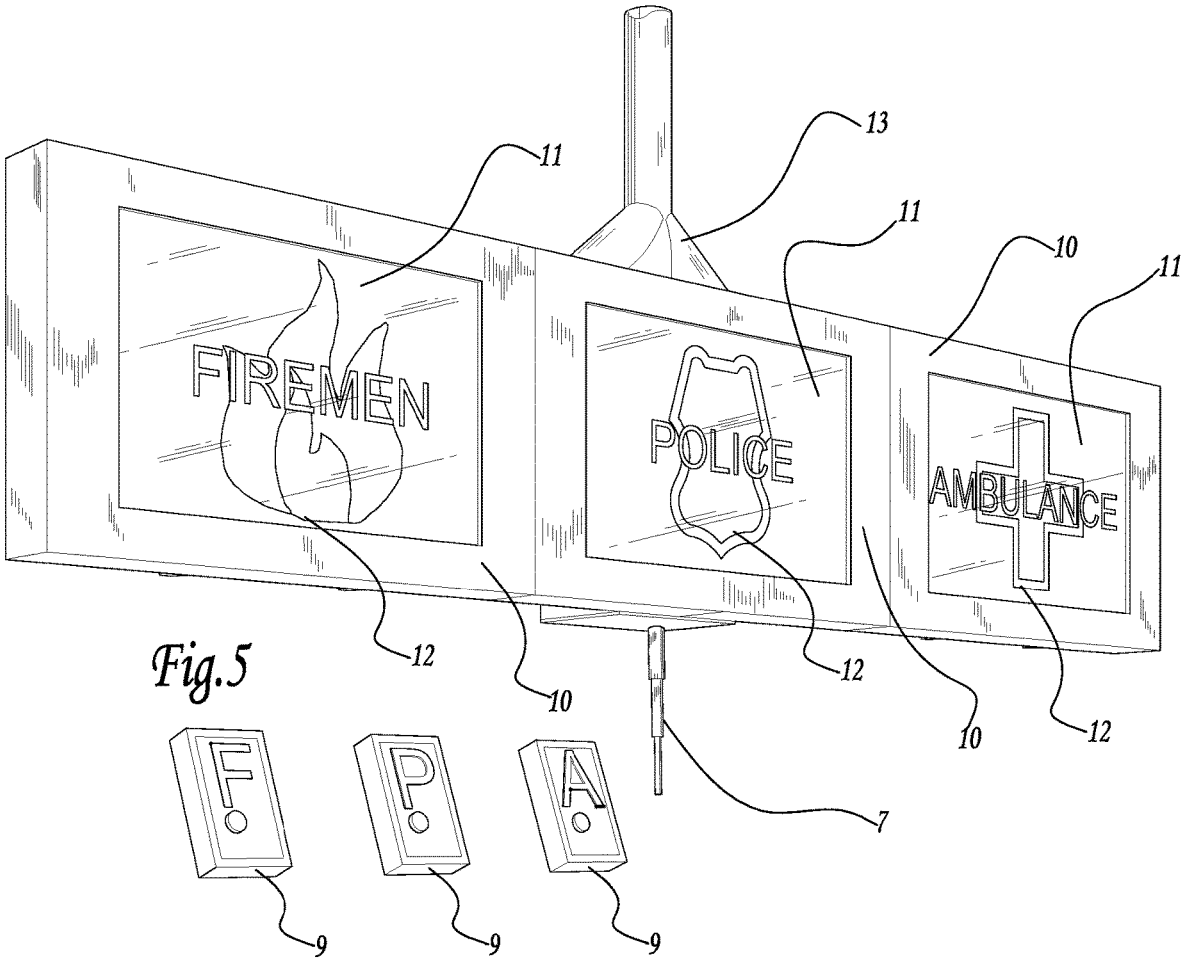
FIG. 4 is a front perspective view of an alternative embodiment of traffic warning system of the present invention.
FIG. 5 is perspective view of the remote control devices of an alternative embodiment of the traffic warning system of the present invention.
Figure 6:
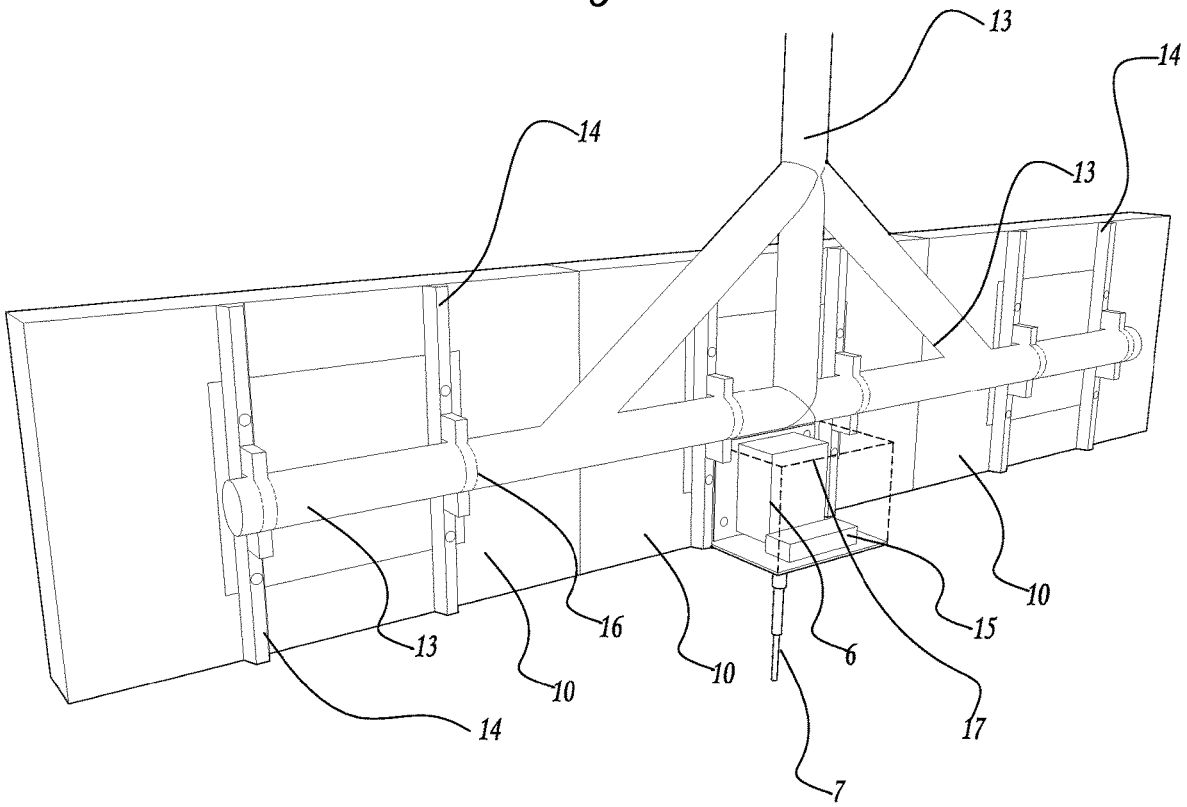
FIG. 6 is a rear perspective view of an alternative embodiment of traffic warning system of the present invention.
Figure 16:
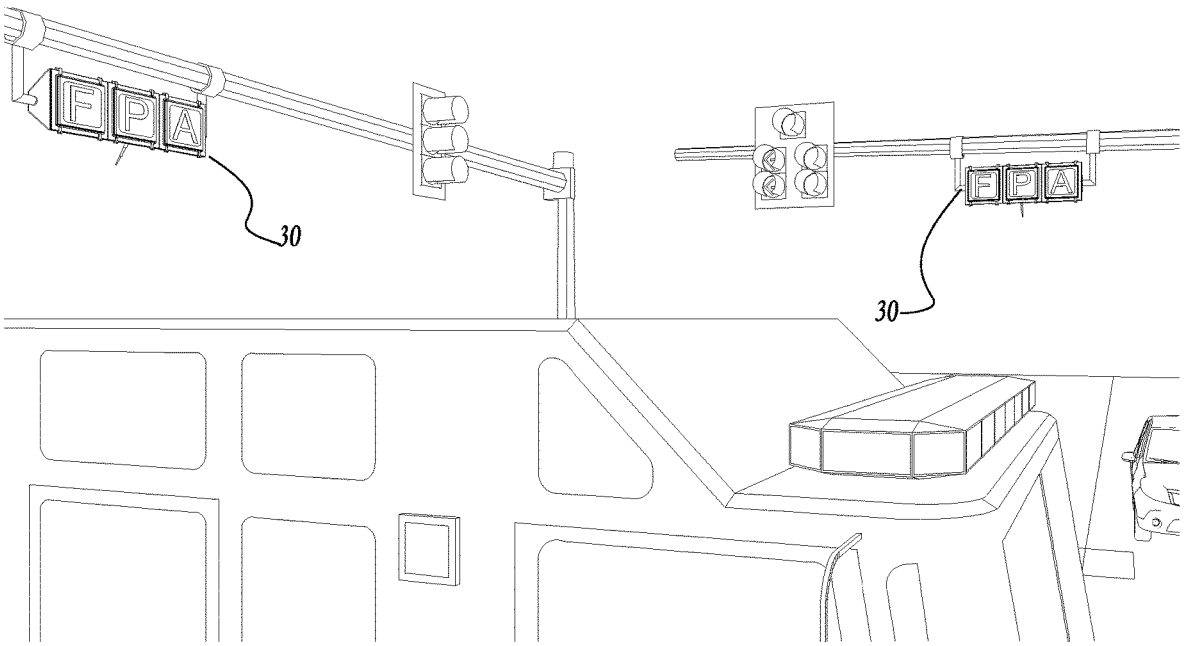
FIG. 16 is an environmental perspective view of the preferred embodiment of traffic warning system of the present invention.

As seen in FIGS. 1-3, perspective views of the traffic warning system are illustrated, in accordance with two embodiments (activation by a remote control device as seen in FIG. 2 or mobile app) of the present invention. The traffic warning system is contained in a waterproof, tamper-proof, and shock-proof housing constructed from materials suitable for sustained exposure to the elements including, but not limited to, rain, snow, hail, lightning, extreme heat/cold, and the like. As seen in FIG. 16, the traffic warning system is sufficiently large enough to be viewed from a distance as a motorist/pedestrian approaches an intersection, but not a cumbersome distraction nor unpleasing aesthetically. Typical standard regulation traffic light module housing is envisioned. Module housing door (or doors) is adapted to the traffic warning system to allow access to the interior of the housing to change light bulbs, maintenance, etc.

In the preferred embodiment as seen in FIG. 3 and FIG. 16, the traffic warning system housing is permanently mounted to the extension arm of a conventional traffic light configuration. The traffic warning system housing can be mounted atop or underneath the extension arm in close proximity to the traffic light. Hence, the traffic warning system is in the direct sight line of an approaching motorist/pedestrian. Ideally, with a 4-way intersection, a traffic warning system housing is installed on each of the four traffic lights, thus visible in the sight line of a motorist/pedestrian in every direction. Based on which mounted housing is activated, a motorist/pedestrian clearly knows what direction an emergency vehicle is approaching and what type of emergency vehicle is approaching.

As seen in FIG. 1, the traffic warning system housing features a front side having a rectangular configuration with separated and serially spaced display windows separated by walls to create separate modules inside the housing. The first display window features a prominent letter "F" to indicate FIRE imposed on red-tinted window substrate is the FIRE module. The second display window features a prominent letter "P" to indication POLICE imposed on blue-tinted window substrate is the POLICE module. The third display window features a prominent letter "A" to indicate AMBULANCE imposed on yellow-tinted window is the AMBULANCE module. An illumination device, such a light bulb or light-emitting diode (LED) arrangement is installed behind each display window. The illumination device can be a rotating bulb or bulbs. These revolving lights may contain a single, stationary bulb around which a curved mirror is spun (or which is attached to a spinning mirror), or a lamp with a Fresnel lens. This creates rotating beam(s) of light, appearing to flash when viewed. Light-emitting diodes are small, completely solid state, very power-efficient, long-lasting (as they have no filaments to burn out) and can be seen very easily even at great distances and in sunlight. The lights in the preferred embodiment are colored bulbs. Red bulbs are used in the FIRE module. Blue bulbs are used in the POLICE module. Yellow (or orange) bulbs are used in the AMBULANCE module.

As seen in FIG. 7, a program controller is disposed in the traffic warning system and is programmed to respond to wireless commands from a first responder having a remote control device and selectively activate and deactivate an illumination device corresponding with the module that corresponds to the type of first responder approaching within a certain distance. The remote control device comprises a transmitter capable of transmitting a signal to a receiver/proximity sensor in the traffic warning system housing capable of receiving and analyzing a signal from the transmitter. The transmitter is adapted to send a signal identifying certain data regarding the emergency vehicle as further described herein, such as the direction and distance of the emergency vehicle. Speed data may also be captured.

The radio frequency receiver, as well as the transmitter, should operate in the VHF or UHF radio spectrum within specific frequency bandwidths allocated for emergency public service communications by the Federal Communications Commission. Any suitable type of modulation, such as AM or FM, may be used to immunize the received signals against noise interference. In the alternative, the two control signals could be multiplied on the same radio frequency signal, with the modulation being optimized to reduce interference. The possibility of unauthorized access or interference to the intersection emergency warning apparatus may be reduced by additional encoding and decoding of the activation signals. As seen in FIGS. 1 and 3, a single (or a plurality (not seen)) monodirectional (or omnidirectional) receiving antenna depends from the exterior surface of the housing of the traffic warning system. As seen in FIG. 2, in a manner similar to a homeowner opening their car garage upon returning home, a user simply depresses the button on the remote control device, which is a radio transmitter, in the direction of the traffic warning system, which contains a radio receiver, and said system activates a module according to the designated frequency.

In an alternative embodiment, a mobile app in conjunction with a global positioning system (GPS) eliminates the need for a remote control device. The mobile app can be activated with a smartphone or multimedia interface in the vehicle with wireless capability. The geolocation functions of the mobile app wirelessly communicate the traffic warning system once the first responder is within a certain distance and the GPS indicates the first responder will pass through the corresponding intersection.

As seen in FIG. 16, when a fire truck approaches an intersection equipped with the traffic warning system, a fireman onboard the fire truck presses a button on a remote control device as seen in FIG. 2. The remote control device will send a signal on a frequency that corresponds to the module having the "F" display window and selectively cause the illumination device behind said display window to selectively energize. Once the energized, the light from the illumination device will appear red due to the red-tinted display window of the FIRE module and/or colored bulb. Thus a motorist/pedestrian knows a fire truck is approaching and conduct themselves accordingly to safety protocols.

As seen in FIG. 1, when a police vehicle approaches an intersection equipped with the traffic warning system, an officer onboard the police vehicle presses a button on a remote control device as seen in FIG. 2. The remote control device will send a signal on a frequency that corresponds to the module having the "P" display window and selectively cause the illumination device behind said display window to selectively energize. Once the energized, the light from the illumination device will appear blue due to the blue-tinted display window of the POLICE module and/or the colored bulb. Thus a motorist/pedestrian knows a police vehicle is approaching and conduct themselves according to safety protocols.

As seen in FIG. 1, when an ambulance approaches an intersection equipped with the traffic warning system, a paramedic onboard the ambulance presses a button on a remote control device as seen in FIG. 2. The remote control device will send a signal on a frequency that corresponds to the module having the "A" display window and selectively cause the illumination device behind said display window to selectively energize. Once the energized, the light from the illumination device will appear yellow due to the yellow-tinted display window of the AMBULANCE module and/or colored bulb. Thus a motorist/pedestrian knows a police vehicle is approaching and conduct themselves according to safety protocols.

As seen in FIG. 1, all of the illumination devices can be activated simultaneously, thus alerting a motorist/pedestrian that Fire, Police, and Ambulance vehicles are rapidly approaching an intersection all at the same time. This gives motorists time to move to the shoulders of roadway to expedite the passage of emergency vehicles, thus saving precious seconds that may save a life, prevent the spread of a fire, or result in apprehending a fleeing criminal. Alternatively, two of the modules, F and P for instance, can have their respective illumination device energized, thus indicating Fire and Police vehicles are rapidly approaching an intersection at the same time, but no Ambulances.

In accordance with typical mobile app protocols, the user must first download the mobile app from an app provider, such as APPLE STORE® or PLAY STORE®, onto the smartphone or other multimedia device installed in the vehicle. Once downloaded, the mobile app may require certain permissions or access to the functionality of the smartphone, such as power consumption, app overrides, memory cards, location, etc. Optionally, the mobile app may require the user create a profile that is accessible with the input of a username or an email address and a password. In alternative embodiments of the invention, logical expansion of the mobile app teaches interfacing the mobile app with wireless service providers and automatically sending audible or visual alerts to the smartphones of motorists and pedestrians once an emergency vehicle is approaching behind them or in their vicinity, thus giving more time for a motorist to move to a shoulder or for a pedestrian to remove earphones and pay attention to their surroundings at an intersection or along a roadway.

The traffic warning system housing is electrically coupled to the power system of the conventional traffic light. As a backup power source in the event of a power outage, a rechargeable solar battery may be situated in the interior of the traffic warning system housing and a corresponding solar panel affixed to exterior of said housing. The housing may also incorporate traffic cameras for the purposes of capturing traffic violations—namely failure to make way for the passage of an emergency vehicle.

Figure 9:
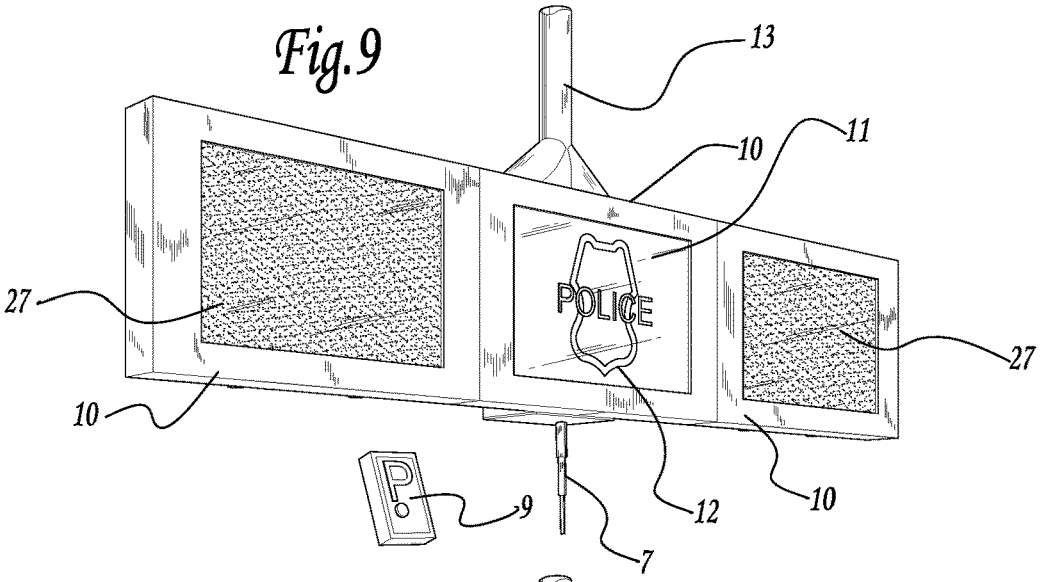
FIG. 9 is a front perspective view of an alternative embodiment of traffic warning system of the present invention in POLICE mode.
Figure 10:
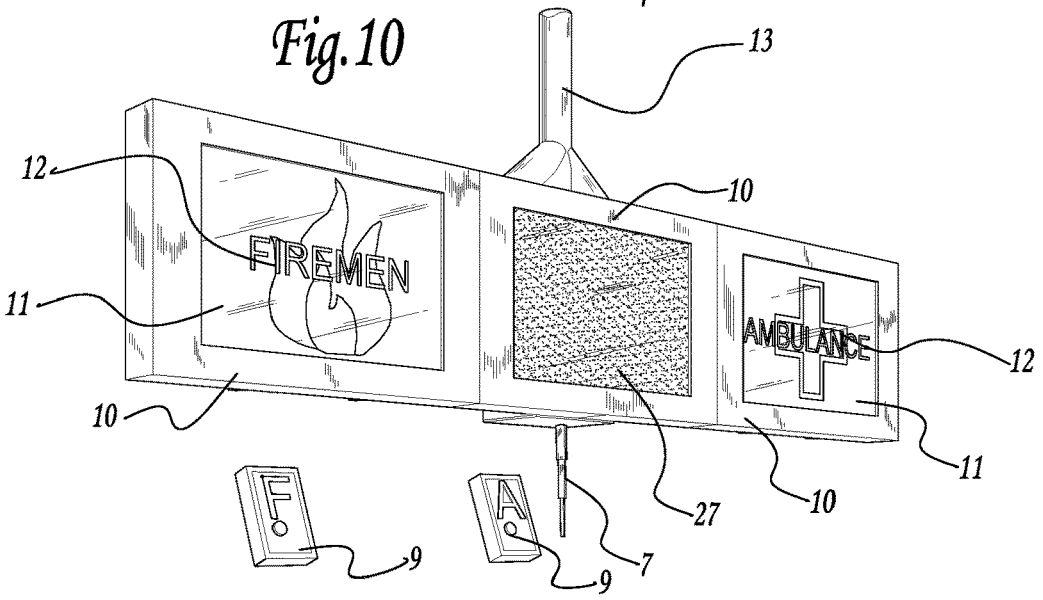
FIG. 10 is a front perspective view of an alternative embodiment of traffic warning system of the present invention in FIRE and AMBULANCE modes.
Figure 11:
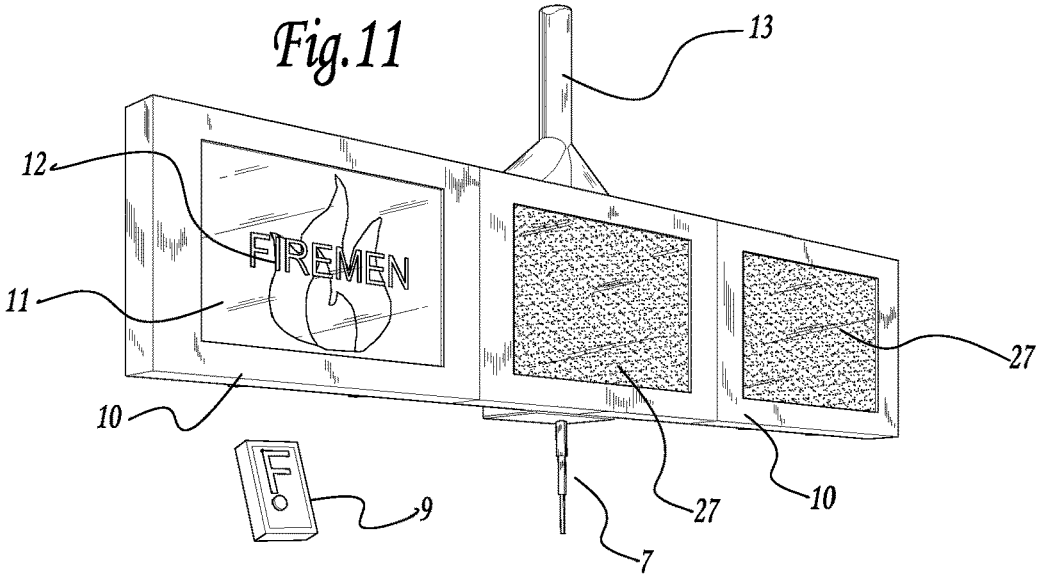
FIG. 11 is a front perspective view of an alternative embodiment of traffic warning system of the present invention in FIRE mode.
Figure 12:
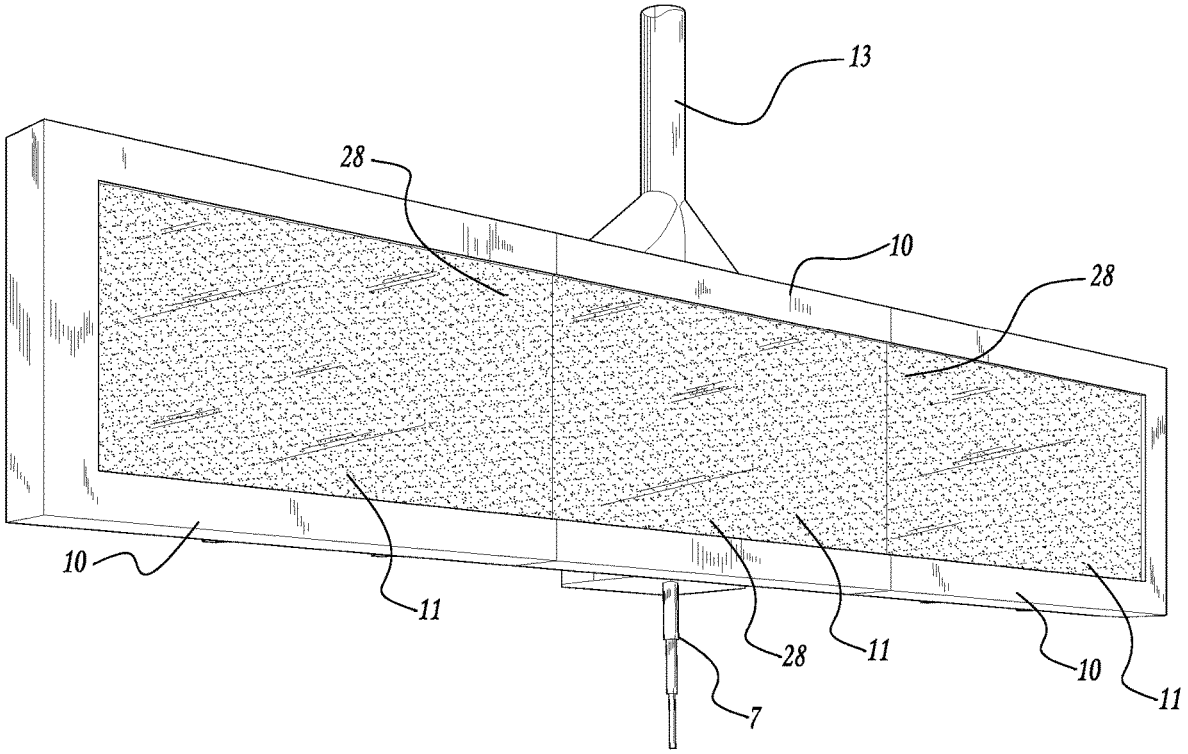
FIG. 12 is a front perspective view of an alternative embodiment of traffic warning system of the present invention.
Figure 13:
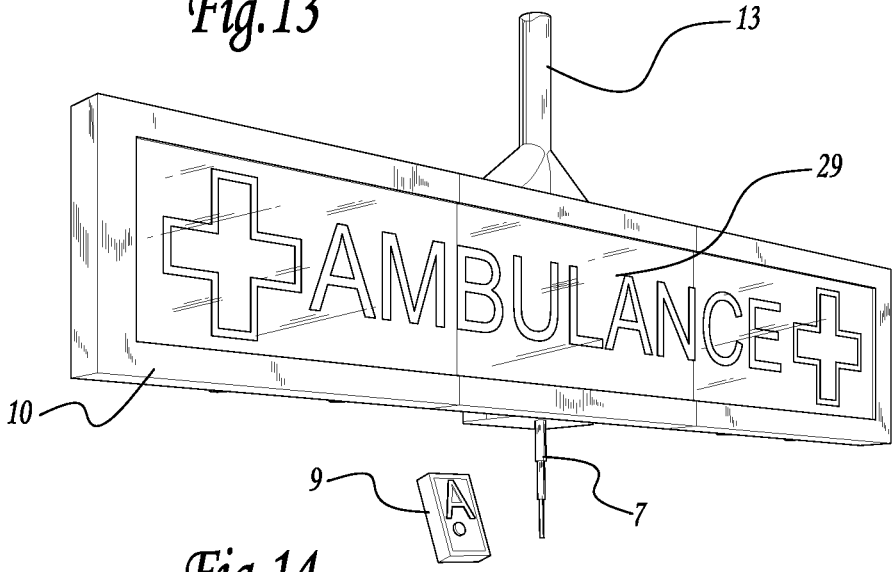
FIG. 13 is a front perspective view of an alternative embodiment of traffic warning system of the present invention in AMBULANCE mode.
Figure 14:
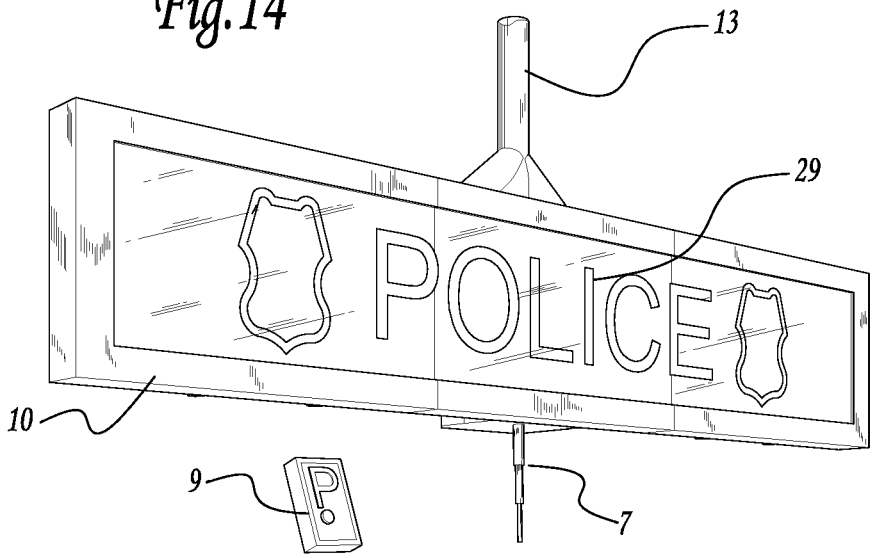
FIG. 14 is a front perspective view of an alternative embodiment of traffic warning system of the present invention in POLICE mode.
Figure 15:
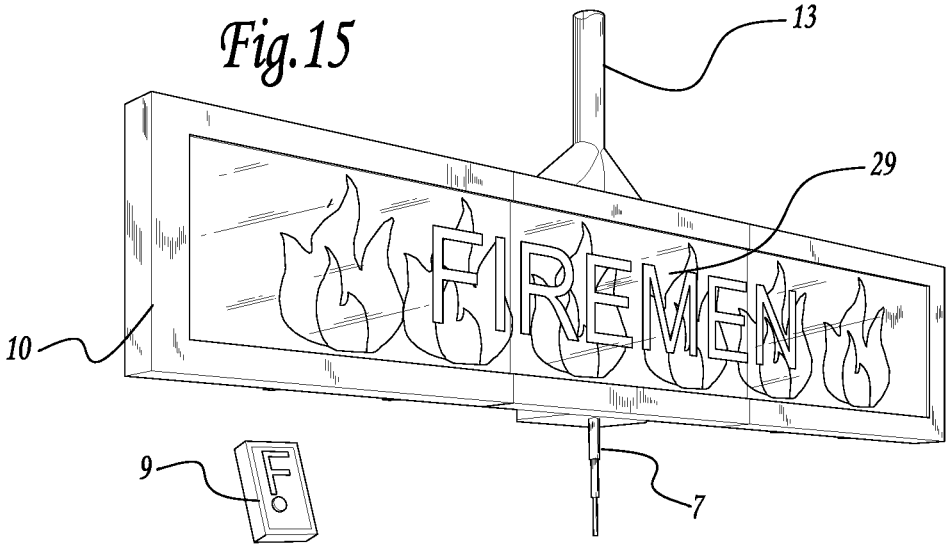
FIG. 15 is a front perspective view of an alternative embodiment of traffic warning system of the present invention in FIRE mode.

An alternative embodiment of the traffic warning system teaches the inclusion of a speaker module having a digital siren to amplify the noise of the siren(s) of the approaching emergency vehicle. Once the button on the respective remote control device is depressed, the integral siren will provide an audible indication of the approaching emergency vehicle in conjunction with the visual indicator of the corresponding module. Hence, a motorist/pedestrian in or approaching an intersection, as seen in FIGS. 9-10, will plainly see an illuminated module(s) as well as hear a siren. Thus, blind pedestrians are afforded an extra layer of protection when walking on or near roadways.

Once an emergency vehicle(s) safely passes through an intersection, the corresponding module(s) can be selectively deactivated by depression of the remote control device by a user aboard the emergency vehicle. A receiver/proximity sensor can also be incorporated in the traffic warning system housing and programmed to automatically deactivate the traffic warning system once the remote control device has safely cleared the intersection. A switch is provided in the receiver to override a signal received by the driver of non-emergency vehicle, and the switch is automatically reset by loss or reduction of signal from the transmitter of the emergency vehicle.

An alternative embodiment of the traffic warning system teaches stand-alone units mounted on poles, mile markers, mileage signs, exit signs, and the like along a highway. These units are self-contained and have a dedicated power source. The stand-alone units are ideal for use on highways where conventional traffic lights are not disposed. The operation of the stand-alone units will function in a manner identical to the preferred embodiment described above.

Figure 17:
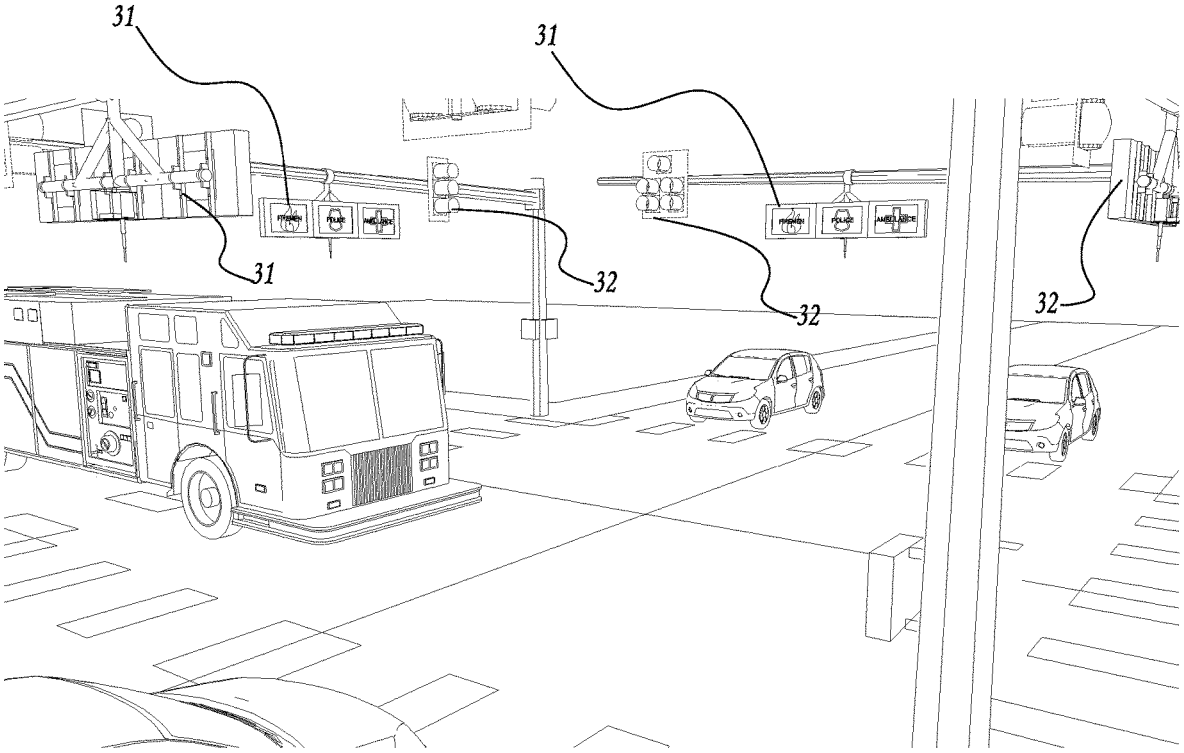
FIG. 17 is an environmental perspective view of an alternative embodiment of traffic warning system of the present invention.
Figure 18:
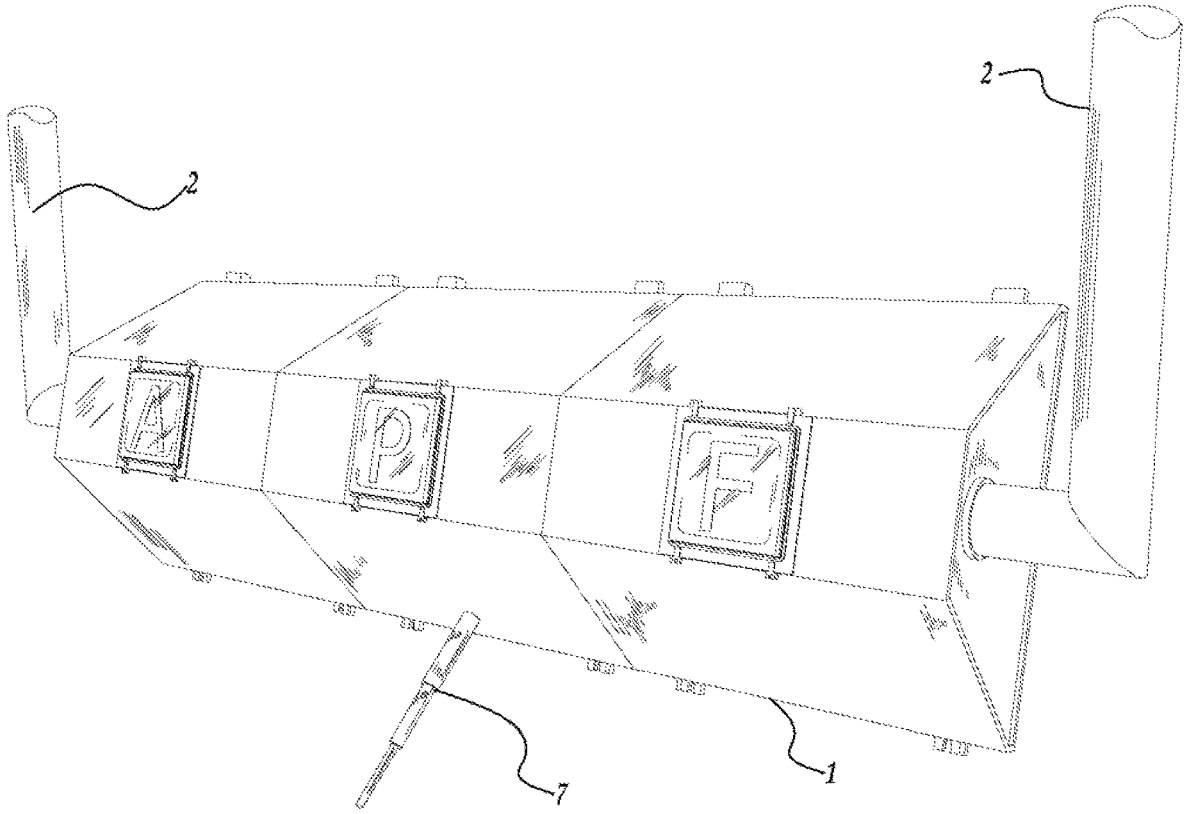
FIG. 18 is a rear perspective view of the traffic warning system of the present invention.

As presently constructed, the rear side of the traffic warning system is not transparent. Hence, still another embodiment of the traffic warning system shown in FIG. 18 features corresponding display windows on the rear side of the housing of the traffic warning system, effectively making each module "see through." This would allow a motorist/pedestrian approaching from either direction to see the visual indication of an approaching emergency vehicle. Thus, a typical four-way intersection, as partially seen in FIGS. 16-17, would only require two mounted traffic warning system housings instead of four traffic warning system housings. One traffic warning system housing would service the north/south direction and one traffic warning system housing would service the east/west direction.

As seen in FIGS. 8-15, still another embodiment of the present invention teaches the incorporation of a video display to visually alert the motorists and pedestrians of approaching first responders. The video display can be CRT electronic displays, plasma display, LED display, normal liquid crystal display (LCD), or very high-brightness LCD display (VHB LCD). When the high-brightness LCD displays (VHB LCD) are used outdoors, the images are very clear with bright colors and wide visual angles, so the high-brightness LCD displays are advantageous for the purposes of this invention. An audio amplifier is connected to the integral speakers for providing sound to the user. A controller/receiver, installed in the housing and used to control the video display and the speakers, may be configured such that when the button on a remote control device is depressed or the mobile app signals an approaching intersection, the controller starts playing: 1. a video with FIREMEN (flashing or static) with graphics, such as a fire, and sound (fire truck siren) associated with the type of first responder. 2. A video with POLICE (flashing or static) with graphics, such as a blue flashing lights, and sound (police siren) associated with the type of first responder. 3. a video with AMBULANCE (flashing or static) with graphics, such as the Red Cross symbol, and sound (ambulance siren) associated with the type of first responder. In addition, the video display can be programmed to display advertisements, news, or other information when the traffic light, supporting the video display, is red and traffic is stopped. Advertisers would pay generously to advertise to a captive audience. The advertisements or other video would end at a predetermined time (e.g., 10-20 seconds) before the light changes so as not to distract motorists. The system can also be adapted to download and update the audio/video content to be played by means of wireless networks (such as CDMA, GPRS, satellites, 802.11 wirelesses LAN) or wired networks (dedicated lines), or a combination of these methods.

As seen in FIGS. 8-15, the alternative embodiments can incorporate glare resistant LCD digital or Dektronic® technology signage monitor screen (with three subsets screens or a continuous screen) with cloud-based technology to update broadcast content through a network such as Wi-Fi, 3G, 4G and 5G. Also, having content that can display a graphic Fresnel lens texture such as red, yellow and green displaying on the monitor screen(s) giving it the capability of being a traffic light that can be controlled by a timer or standard traffic support bracing as required.

As seen in FIGS. 8-15 and FIG. 17, support bracing is disposed therein. Pipe bracing is disposed therein.

EXAMPLE A: Frequencies with different digital addresses or a coding scheme for each first responder. For example, each country, state, county, and city will have a digital code address for each first responder along with a prefix such as F (Fireman), P (Police) and A (Ambulance). For a Fireman first responder in Birmingham Ala., the digital address would be US, AL JEFF, BHAM_F01.

Also, alternatively, an encryption code can be used as well as frequencies using a rolling code, or Frequency-hopping spread spectrum method, transmitting radio signals by rapidly changing the carrier frequency among many distinct frequencies to avoid interference, to prevent eavesdropping, and to enable code-division multiple access.

Graphic Fresnel lens texture screen that is displayed as red to warn motorists to stop anytime when one or more of the graphic animation videos are activated by a first responder. As an added safety feature, once one or more of the graphic Fresnel lens texture screens are red commanding motorists to stop, a safety message or messages displaying "Drive Safety", Please Buckle Your Seat Belt and the Speed Limit(s) and as well as live stream broadcast content safety advertisement videos may appear while motorists wait for the graphic Fresnel lens screen to be activated by the traffic timer to turn green to go.

A seamless LCD digital or Dektronic® technology signage monitor graphic fresnal lens screens displaying one traffic color at a time, such as red across one or all screens for stop, yellow for caution and green for go that is controlled by a standard traffic timer. As an added safety feature, once one or more of the graphic Fresnel lens texture screens are red commanding motorists to stop, a safety message or messages displaying "Drive Safety", Please Buckle Your Seat Belt and the Speed Limit(s) and as well as live stream broadcast content safety advertisement videos may appear while motorists wait for the graphic fresnal lens screen to be activated by the traffic timer to turn green to go. Finally, animated video graphics activated by first responders.

The proposed traffic light warning system module(s) with three displaying LED backlit or light bulb lit windows that features a "F" to indicate FIRE, "P" to indicate POLICE and "A" to indicate AMBULANCE. Proposed glare resistance LCD digital or Dektronic technology signage monitor screen traffic warning system.

While the preferred embodiment of the traffic warning system has been described in detail, it should be apparent that modifications and variations thereto are possible, all of which fall within the true spirit and scope of the invention. With respect to the above description then, it is to be realized that the optimum functionality for the components of the invention, to include variations in dimensions and functionality are deemed readily apparent and obvious to one skilled in the art, and all equivalent relationships to those illustrated in the appendices, images, and embodiments described in the specification are intended to be encompassed by the present embodiment of the invention. Moreover, the scope of this invention anticipates the incorporation of the above teachings in tablets, wearable computers, and the like. Hence, the present invention has been described above in terms of specific embodiments, it is to be understood that the invention is not limited to these disclosed embodiments.

The invention claimed is:

1. A traffic warning system, comprising:

a warning system housing including module display windows and an integrated radio frequency receiver;

a transmitter for each of two or more first responders, each transmitter configured to transmit a signal to the radio frequency receiver for alerting motorists and pedestrians of emergencies at intersections, wherein the radio frequency receiver and each transmitter operates in the VHF or UHF radio spectrum within frequency bandwidths allocated for emergency public service communications by the Federal Communications Commission;

a coding scheme and frequency for the transmitter of each first responder communicating wirelessly with the radio frequency receiver, wherein the coding scheme includes a digital code address and a prefix for each first responder;

an encryption code and frequencies using a rolling code, frequency-hopping spread spectrum method, transmitting radio signals by rapidly changing the carrier frequency among many distinct frequencies avoiding interference, preventing eavesdropping, and enabling code-division multiple access; and a local area computer network, a wide area computer network, or a combination of networks facilitating transmission and receipt of commands associated with operation of the traffic warning system.

2. The traffic warning system of claim 1, wherein said module display windows are serially spaced and each include a letter indicating the type of first responder.

3. The traffic warning system housing of claim 1, wherein the module display windows include prominent letters F for fire, P for police, and A for ambulance.

4. The traffic warning system of claim 3, wherein the digital code address for each first responder indicates the country, state, county, and city.

5. The traffic warning system of claim 1, wherein the module display windows include glare resistant LCD digital technology signage monitor screens.

6. The traffic warning system of claim 5, further comprising content configured to display a graphic Fresnel lens texture on the monitor screens to enable the monitor screens to be controlled by a timer.

7. A traffic warning system, comprising:

a warning system housing including module display windows and an integrated radio frequency receiver, wherein the radio frequency receiver operates in the VHF or UHF radio spectrum within frequency bandwidths allocated for emergency public service communications by the Federal Communications Commission;

a coding scheme and frequency for each first responder communicating wirelessly for emergencies at intersections for alerting motorists and pedestrians;

a digital code address and a prefix for each first responder;

a transmitter;

an encryption code and frequencies using a rolling code, frequency-hopping spread spectrum method, transmitting radio signals by rapidly changing the carrier frequency among many distinct frequencies avoiding interference, preventing eavesdropping, and enabling code-division multiple access; and a local area computer network, a wide area computer network, or a combination of networks facilitating transmission and receipt of commands associated with operation of the traffic warning system.

8. The traffic warning system of claim 7, wherein said module display windows are serially spaced and each include a letter indicating the type of first responder.

9. The traffic warning system housing of claim 7, wherein the module display windows include prominent letters F for fire, P for police, and A for ambulance.

10. The traffic warning system of claim 9, wherein the digital code address for each first responder indicates the country, state, county, and city.

11. The traffic warning system of claim 7, wherein the module display windows include glare resistant LCD digital technology signage monitor screens.

12. The traffic warning system of claim 11, further comprising content configured to display a graphic Fresnel lens texture on the monitor screens to enable the monitor screens to be controlled by a timer.

13. A traffic warning system, comprising:

a warning system housing including glare resistant LCD digital technology signage monitor screens, an integrated radio frequency receiver, wherein the radio frequency receiver operates in VHF or UHF radio spectrum within frequency bandwidths allocated for emergency public service communications by the Federal Communications Commission;

content that can display a graphic Fresnel lens texture on the monitor screens to enable the monitor screens to be controlled by a timer;

a coding scheme and frequency for each first responder communicating wirelessly for emergencies for alerting motorists and pedestrians;

a digital code address and a prefix for each first responder;

a transmitter;

a local area computer network, wide area computer network, or a combination of networks facilitating transmission and receipt of commands associated with operation of the traffic warning system;

an encryption code and frequencies using a rolling code, frequency-hopping spread spectrum method and transmitting radio signals by rapidly changing the carrier frequency among many distinct frequencies avoiding interference preventing eavesdropping, and to enable code-division multiple access.

14. The traffic warning system of claim 13, wherein said monitor screens are windows serially spaced and include a video graphic symbol display indicating the type of first responder.

15. The traffic warning system housing of claim 14, wherein said monitor screens play a video with FIREMEN with graphics and sound associated with the type of first responder; a video with POLICE with graphics and sound associated with the type of first responder; a video with AMBULANCE with graphics and sound associated with the type of first responder.

16. The traffic warning system of claim 15, wherein the graphics and sound on the video with FIREMEN include fire and a fire truck siren.

17. The traffic warning system of claim 15, wherein the graphics and sound on the video with POLICE include blue flashing lights and a police siren.

18. The traffic warning system of claim 15, wherein the graphics and sound on the video with AMBULANCE include a Red Cross symbol and an ambulance siren.

19. The traffic warning system of claim 11, wherein the digital code address for each first responder indicates the country, state, county, and city.

* * * * *